US010113260B2

(12) United States Patent
Leany et al.

(10) Patent No.: US 10,113,260 B2
(45) Date of Patent: Oct. 30, 2018

(54) LAUNDRY TREATING APPLIANCE

(71) Applicant: WHIRLPOOL CORPORATION, Benton Harbor, MI (US)

(72) Inventors: Thaylen K. Leany, Saint Joseph, MI (US); Brenner M. Sharp, Bridgman, MI (US); Kurt Werner, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 225 days.

(21) Appl. No.: 14/809,709

(22) Filed: Jul. 27, 2015

(65) Prior Publication Data

US 2017/0029998 A1 Feb. 2, 2017

(51) Int. Cl.
*D06F 37/40* (2006.01)

(52) U.S. Cl.
CPC ..... *D06F 37/40* (2013.01)

(58) Field of Classification Search
CPC ..... D06F 37/40
USPC ..... 68/12.24
See application file for complete search history.

(56) References Cited

U.S. PATENT DOCUMENTS

| | | | | |
|---|---|---|---|---|
| 3,257,830 | A | 6/1966 | Shelton | |
| 4,232,536 | A | 11/1980 | Koseki et al. | |
| 4,551,073 | A | 11/1985 | Schwab | |
| 5,642,797 | A * | 7/1997 | Wall | F16D 27/112 192/84.961 |
| 5,661,990 | A | 9/1997 | Chong | |
| 6,202,451 | B1 | 3/2001 | Park et al. | |
| 6,318,133 | B1 | 11/2001 | Koshiga et al. | |
| 6,394,924 | B1 | 5/2002 | Schiebold et al. | |
| 7,223,196 | B2 | 5/2007 | Fruehwald et al. | |
| 7,520,190 | B2 | 4/2009 | Hasegawa et al. | |
| 8,133,143 | B2 | 3/2012 | Schoon | |
| 8,449,429 | B2 | 5/2013 | Palfai et al. | |
| 8,633,622 | B2 | 1/2014 | Chamberlin et al. | |
| 8,771,123 | B2 | 7/2014 | Palfai et al. | |
| 2002/0111243 | A1 | 8/2002 | Minegishi et al. | |
| 2004/0139768 | A1 | 7/2004 | Kim et al. | |
| 2006/0144175 | A1 | 7/2006 | Nawa et al. | |
| 2007/0216250 | A1 * | 9/2007 | Ahn | H02K 1/2786 310/156.43 |

(Continued)

FOREIGN PATENT DOCUMENTS

| | | | |
|---|---|---|---|
| CN | 1321279 C | * | 6/2007 |
| CN | 203462307 U | * | 3/2014 |

(Continued)

OTHER PUBLICATIONS

Machine translation of CN 203462307 U, dated Mar. 2014.*
Machine translation of JP 2001046784 A, dated Feb. 2001.*

*Primary Examiner* — Michael E Barr
*Assistant Examiner* — Kevin G Lee

(57) ABSTRACT

A laundry treating appliance configured to implement a cycle of operation to treat a load of laundry includes a basket defining a treating chamber and rotatable about an axis of rotation, a motor having a rotor and a stator, and a shifter within the interior diameter of the stator and having an energizable clutch coil at least partially enveloped in a magnetically permeable housing and a magnetically permeable slidable drive mechanism radially spaced from the housing and configured to selectively couple the basket with the rotor.

20 Claims, 5 Drawing Sheets

(56) References Cited

U.S. PATENT DOCUMENTS

| | | | |
|---|---|---|---|
| 2009/0321214 | A1 | 12/2009 | Hoshino et al. |
| 2012/0286629 | A1 | 11/2012 | Johnson et al. |
| 2013/0000938 | A1 | 1/2013 | Matsunaga et al. |

FOREIGN PATENT DOCUMENTS

| | | | | |
|---|---|---|---|---|
| CN | 103422323 | B | * | 9/2015 |
| JP | 2001046784 | A | * | 2/2001 |

* cited by examiner

LAUNDRY TREATING APPLIANCE

BACKGROUND

Laundry treating appliances, such as a washing machine, can include a basket defining a treating chamber for receiving and treating a laundry load according to a cycle of operation. The laundry treating appliance can include a drum defining a treating chamber that is rotatable, as driven by a motor. The motor can further include a shifter or clutch mechanism to controllably engage or disengage the rotation of the drum.

BRIEF SUMMARY

In one aspect, a laundry treating appliance configured to implement a cycle of operation to treat a load of laundry includes a drum defining a treating chamber and rotatable about an axis of rotation, a motor having a rotor and a stator, a shifter within an interior diameter of the stator and having an energizable clutch coil at least partially enveloped in a magnetically permeable housing and a magnetically permeable slidable drive mechanism radially spaced from the housing and configured to selectively couple the drum with the rotor, and a concentric magnetically permeable ring located on the rotor, radially spaced from the magnetically permeable housing and axially spaced from the slidable drive mechanism.

In another aspect, a laundry treating appliance configured to implement a cycle of operation to treat a load of laundry includes a drum defining a treating chamber and rotatable about an axis of rotation, a motor having a rotor and a stator, a shifter within an interior diameter of the stator and having an energizable clutch coil at least partially enveloped in a magnetically permeable housing and a magnetically permeable slidable drive mechanism radially spaced from the housing to define a first gap and configured to selectively couple the drum with the rotor, and a concentric magnetically permeable ring located on the rotor, radially spaced from housing to define a second gap, and axially spaced from the slidable drive mechanism to define a third gap. The housing, slidable drive mechanism, ring, first gap, second gap, and third gap define a flux path of least magnetic reluctance for a magnetic field selectively generated by the energizable clutch coil.

DETAILED DESCRIPTION

Figure 1:
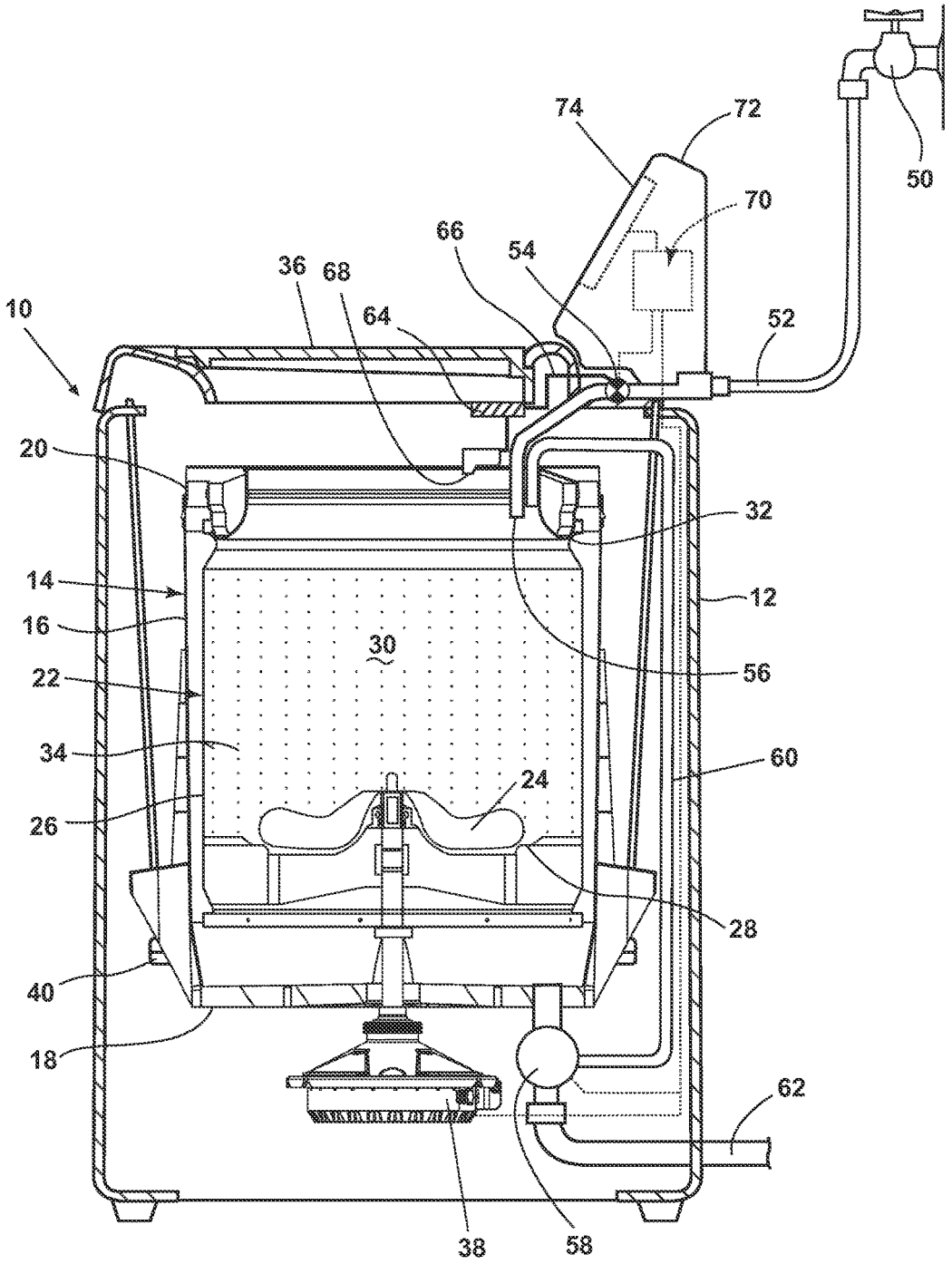
FIG. 1 is a schematic sectional view of a laundry treating appliance in the form of a washing machine.

FIG. 1 is a schematic view of a laundry treating appliance according to an exemplary embodiment. The laundry treating appliance can be any appliance that performs a cycle of operation to clean or otherwise treat items placed therein, non-limiting examples of which include a vertical axis clothes washing machine, a combination washing machine and dryer, a tumbling or stationary refreshing/revitalizing machine, an extractor, a non-aqueous washing apparatus, and a revitalizing machine.

As used herein, the "vertical axis" washing machine refers to a washing machine having a rotatable drum/basket (used interchangeably herein), perforate or imperforate, that holds fabric items and a laundry mover, such as an agitator, impeller, and the like within the drum. The clothes mover moves within the drum to impart mechanical energy directly to the clothes or indirectly through liquid in the drum. The clothes mover can typically be moved in a reciprocating rotational movement. In some vertical axis washing machines, the drum rotates about a vertical axis generally perpendicular to a surface that supports the washing machine. However, the rotational axis need not be vertical. The drum can rotate about an axis inclined relative to the vertical axis.

The laundry treating appliance of FIG. 1 is illustrated as a vertical axis washing machine 10, which can include a structural support system comprising a cabinet 12 that defines a housing within which a laundry holding system resides. The cabinet 12 can be a housing having a chassis and/or a frame, defining an interior receiving components typically found in a conventional washing machine, such as motors, pumps, fluid lines, controls, sensors, transducers, and the like. Such components will not be described further herein except as necessary for a complete understanding of the invention.

The laundry holding system of the illustrated exemplary washing machine 10 can include a watertight tub 14 installed in the cabinet 12. The tub 14 can have a generally cylindrical side or peripheral wall 16 closed at its bottom end by a base 18 that can at least partially define a sump and open at an upper end 20 to define an opening to an interior of the tub 14 for holding liquid. A perforated basket 22 can be mounted in the tub 14 for rotation about an axis of rotation, such as, for example, a central, vertical axis extending through the center of a laundry mover 24 in the form of an impeller, as an example, located within the basket 22. Other exemplary types of laundry movers include, but are not limited to, an agitator, a wobble plate, and a hybrid impeller/agitator. The basket 22 can have a generally cylindrical side or peripheral wall 26 closed at its bottom end by a base 28 to form an interior at least partially defining a laundry treating chamber 30 receiving a load of laundry items for treatment and open at an upper end 32 to provide access to the treating chamber 30. The peripheral wall 26 can include a plurality of perforations or apertures 34 such that liquid supplied to the basket 22 can flow through the perforations 34 to the tub 14. The top of the cabinet 12 can include a selectively openable lid 36 to provide access into the laundry treating chamber 30 through an open top of the basket 22.

A drive system including a drive motor 38, which can include a gear case, can be utilized to rotate the basket 22 and the laundry mover 24. The motor 38 can rotate the basket 22 in either rotational direction and at various speeds, including at a spin speed wherein a centrifugal force at the inner surface of the basket peripheral wall 26 is 1 g or greater. The centrifugal force at a spin speed distributes the laundry about a periphery of the basket, and spin speeds are commonly known for use in extracting liquid from the laundry items in the basket 22, such as after a wash or rinse step in a treating cycle of operation. The motor 38 can also oscillate or rotate the laundry mover 24 about its axis of rotation during a cycle of operation in order to provide movement to the load contained within the laundry treating chamber 30. In this sense, the motor 38 can be configured to operably move the laundry mover 24 independent of the basket 22, or can co-rotate the laundry mover 24 and basket 22 in unison. One non-limiting example of the motor 38 can include a brushless permanent magnet (BPM) motor. Other motors, such as an induction motor or a permanent split capacitor (PSC) motor, can also be used.

A suspension system 40 can dynamically hold the tub 14 within the cabinet 12. The suspension system 40 can dissipate a determined degree of vibratory energy generated by the rotation of the basket 22 and/or the laundry mover 24 during a treating cycle of operation. Together, the tub 14, the basket 22, and any contents of the basket 22, such as liquid and laundry items, define a suspended mass for the suspension system 40. The suspension system 40 can be any type of suspension system and is not germane to the invention.

The washing machine 10 can be fluidly connected to a liquid supply 50 through a liquid supply system including a liquid supply conduit 52 having a valve assembly 54 that can be operated to selectively deliver liquid, such as water, to the tub 14 through a liquid supply outlet 56, which is shown by example as being positioned at one side of the tub 14. The washing machine 10 can further include a recirculation and drain system having a pump assembly 58 that can pump liquid from the tub 14 back into the tub 14 through a recirculation conduit 60 for recirculation of the liquid and/or to a drain conduit 62 to drain the liquid from the machine 10. The illustrated liquid supply system and recirculation and drain system for the washing machine 10 are provided for exemplary purposes only and are not limited to those shown in the drawings and described above; the particular liquid supply system and recirculation and drain system are not germane to the invention.

The washing machine 10 can also be provided with a dispensing system for dispensing treating chemistry to the basket 22, either directly or mixed with water from the liquid supply system, for use in treating the laundry according to a cycle of operation. The dispensing system can include a dispenser 64 which can be a single use dispenser, a bulk dispenser, or a combination of a single use and bulk dispenser. Water can be supplied to the dispenser 64 from the liquid supply conduit 52 by directing the valve assembly 54 to direct the flow of water to the dispenser 64 through a dispensing supply conduit 66. The dispenser 64 can include a dispensing nozzle 68 configured to dispense the treating chemistry in a desired pattern and under a desired amount of pressure. For example, the dispensing nozzle 68 can be configured to dispense a flow or stream of treating chemistry by gravity, i.e., a non-pressurized stream.

Non-limiting examples of treating chemistries that can be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The washing machine 10 can also be provided with a heating system (not shown) to heat liquid provided to the treating chamber 30. In one example, the heating system can include a heating element provided in the sump to heat liquid that collects in the sump. Alternatively, the heating system can be in the form of an in-line heater that heats the liquid as it flows through the liquid supply, dispensing, and/or recirculation systems. Another example of a heating system can be a stream generator, such as a flow through steam generator or a tank-type steam generator. Moreover, the heating system can include a combination of these exemplary heaters or other types of heaters.

The liquid supply, dispensing, and recirculation and drain systems can differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry. For example, the liquid supply system and/or the dispensing system can be configured to supply liquid into the interior of the tub 14 not occupied by the basket 22 such that liquid can be supplied directly to the tub 14 without having to travel through the basket 22.

The washing machine 10 can further include a control system for controlling the operation of the washing machine 10 to implement one or more treating cycles of operation. The control system can include a controller 70 located within a console 72 or elsewhere, such as within the cabinet 12, and a user interface 74 that is operably coupled with the controller 70. The user interface 74 can include one or more knobs, dials, switches, displays, touch screens and the like for communicating with the user, such as to receive input and provide output. The user can enter different types of information including, without limitation, cycle selection and cycle parameters, such as cycle options.

The controller 70 can include the machine controller and any additional controllers provided for controlling any of the components of the washing machine 10. For example, the controller 70 can include the machine controller and a motor controller. Many known types of controllers can be used for the controller 70. The specific type of controller is not germane to the invention. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), can be used to control the various components.

Figure 2:
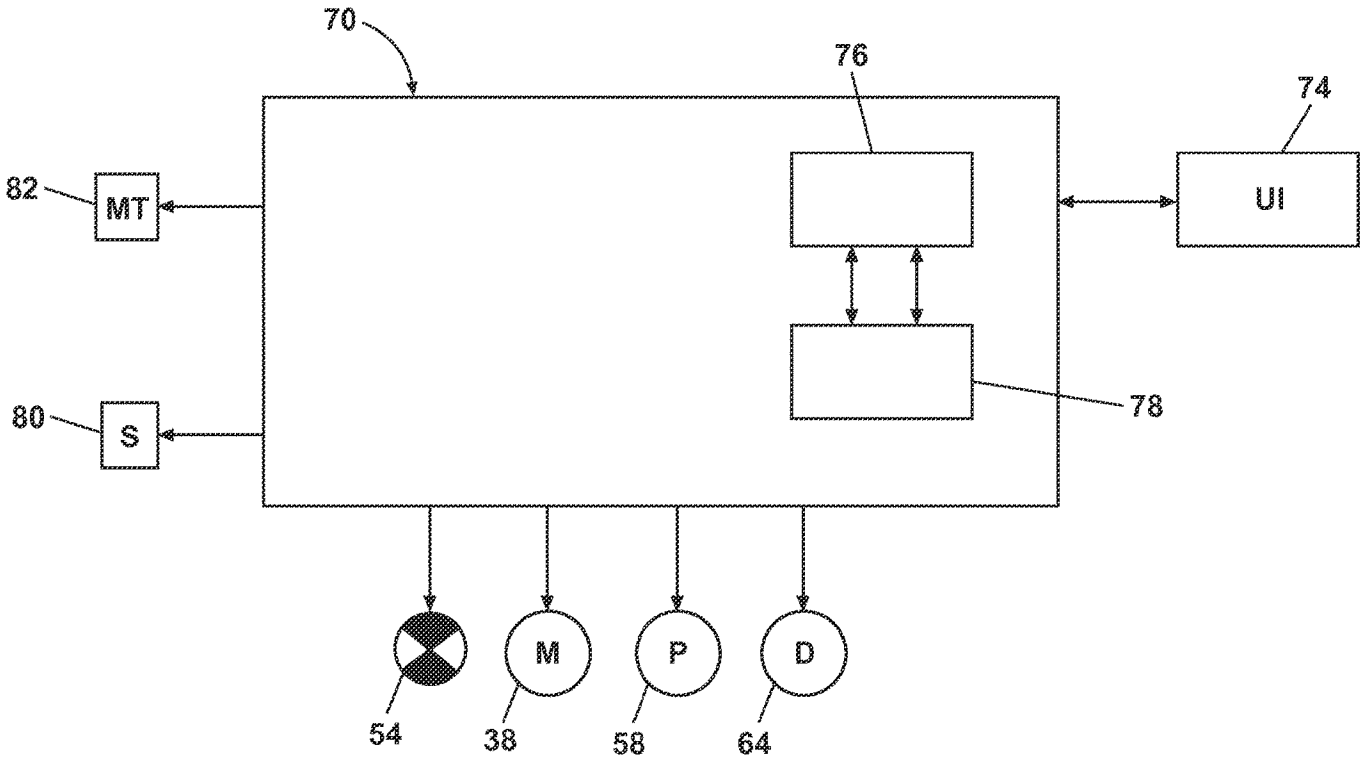
FIG. 2 is a schematic view of a control system for the laundry treating appliance of FIG. 1.

As illustrated in FIG. 2, the controller 70 can be provided with a memory 76 and a central processing unit (CPU) 78. The memory 76 can be used for storing the control software that is executed by the CPU 78 in completing a treating cycle of operation using the washing machine 10 and any additional software. Examples, without limitation, of treating cycles of operation include: wash, heavy duty wash, delicate wash, quick wash, pre-wash, refresh, rinse only, and timed wash. The memory 76 can also be used to store information, such as a database or table, and to store data received from one or more components of the washing machine 10 that can be communicably coupled with the controller 70. The database or table can be used to store the various operating parameters for the one or more cycles of operation, including factory default values for the operating parameters and any adjustments to them by the control system or by user input.

The controller 70 can be operably coupled with one or more components of the washing machine 10 for communicating with and controlling the operation of the component to complete a cycle of operation. For example, the controller 70 can be operably coupled with the motor 38, the valve assembly 54, the pump assembly 58, the dispenser 64, and any other additional components that can be present, such as a steam generator and/or a sump heater (not shown), to control the operation of these and other components to implement one or more of the cycles of operation. In another example, the controller 70 can be operably coupled with the motor 38 to control the operation of the rotation of the basket 22 or the laundry mover 24. The controller 70 can also be coupled with one or more sensors 80 provided in one or more of the systems of the washing machine 10 to receive input from the sensors, an example of which includes a motor torque sensor 82.

The motor torque sensor 82 can include a motor controller or similar data output on the motor 38 that provides data communication with the motor 38 and outputs motor characteristic information such as oscillations, generally in the form of an analog or digital signal, to the controller 70 that is indicative of the applied torque. The controller 70 can use the motor characteristic information to determine the torque applied by the motor 38 using a computer program that can be stored in the controller memory 76. Specifically, the motor torque sensor 82 can be any suitable sensor, such as a voltage and/or current sensor, for outputting a current and/or voltage signal indicative of the current and/or voltage supplied to the motor 38 to determine the torque applied by the motor 38. Additionally, the motor torque sensor 82 can be a physical sensor or can be integrated with the motor 38 and combined with the capability of the controller 70, can function as a sensor. For example, motor characteristics, such as speed, current, voltage, direction, torque, etc., can be processed such that the data provides information in the same manner as a separate physical sensor. In contemporary motors, the motor 38 often has their own controller that outputs data for such information.

Figure 3:
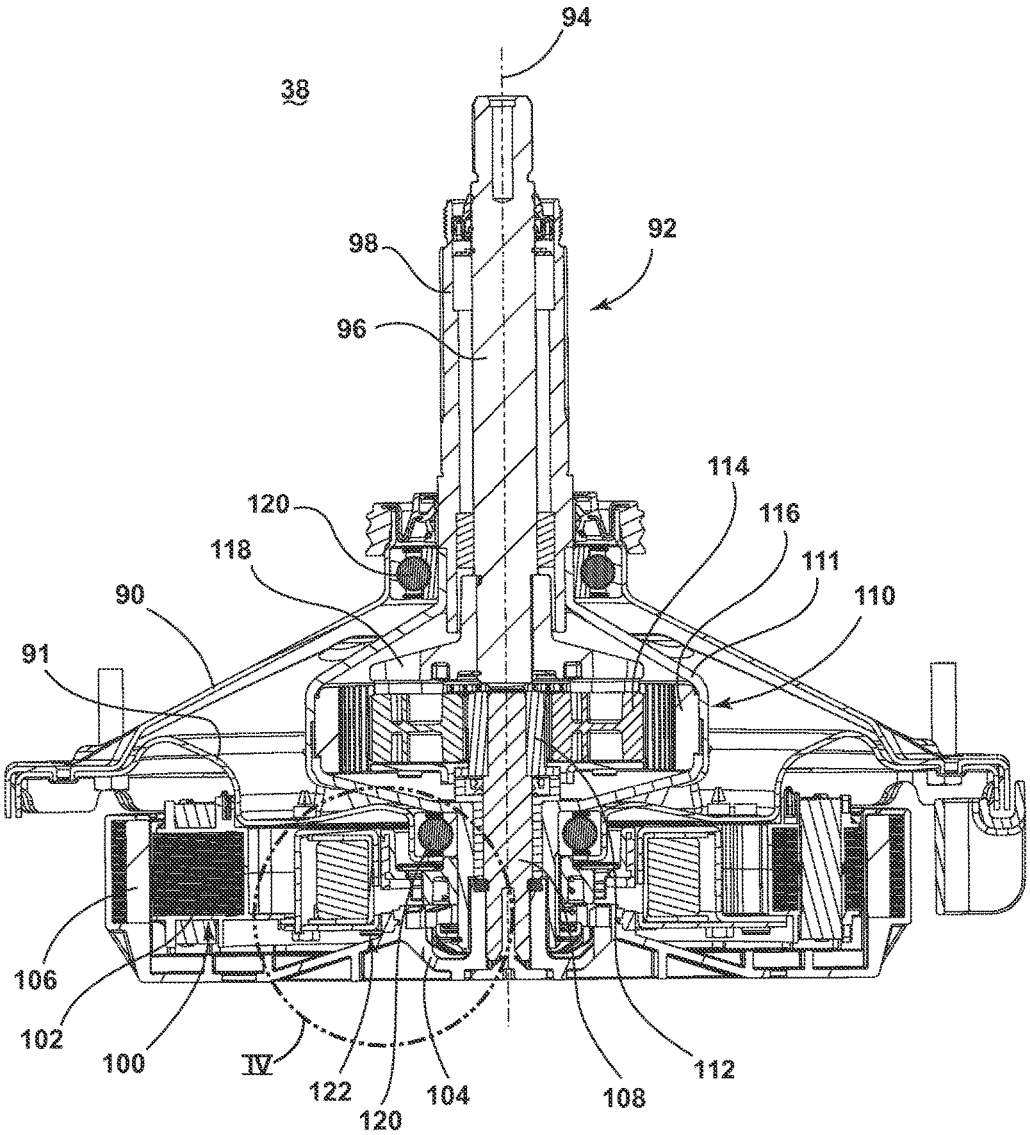
FIG. 3 is cross section of the motor according to one embodiment implemented by the washing machine of FIG. 1.

FIG. 3 illustrates a cross section of the motor 38 shown in FIG. 1. The motor 38 can include an upper housing body 90, a lower housing body 91, and an output drive shaft 92 configured to rotate about an axis of rotation 94. The output drive shaft 92 can further include a first drive shaft 96 configured to couple with and rotate the laundry mover 24 and a second drive shaft 98 configured to couple with and rotate the basket 22. As shown, the first drive shaft 96 can be concentric to, and positioned within the interior diameter of the second drive shaft 98. Each drive shaft 96, 98 can be configured to rotate, for example, independently of the other, in unison with the other, or at dissimilar rotational speeds or directions from the other.

The motor 38 can further include a stator 100 supported by the lower housing body 91 and having an energizable stator coil 102. The stator coil 102 is radially spaced from at least a portion of a rotor 104, such as the permanent magnet 106 (when the motor 38 is a BPM motor) or rotor coil. The rotor 104 is rotationally coupled with a rotor drive shaft 108 which can further couple with a gearbox, illustrated as a speed-reducing planetary gearbox 110. The planetary gearbox 110 can include a gearbox housing 111, a sun gear 112, a set of planet gears 114, and an outer concentric ring gear 116, wherein the gears 112, 114, 116 are positioned within the housing 111. The sun gear 112 is rotationally coupled with the rotor drive shaft 108, and includes gears configured to mesh with and rotate the set of planet gears 114 positioned concentrically about the sun gear 112 and within the outer ring gear 116. The ring gear 116 can be fixedly mounted with the gearbox housing 111. Each of the planet gears 114 is coupled with an arm 118 such that the rotation of the planet gears 114 about the ring gear 116, as driven by the sun gear 112, rotates the arms 118 about the axis of rotation 94. The arms 118 can be further coupled with the first drive shaft 96 to rotate the laundry mover 24.

As shown, the planetary gearbox 110 is configured in a speed-reducing configuration, such that the output rotational speed of the first drive shaft 96 is less than the rotational speed of the rotor drive shaft 108. The planetary gearbox 110, sun gear 112, planet gears 114, ring gear 116, and the like, can be configured or selected to provide a desired rotational speed-reducing ratio based on the rotational speed of the rotor drive shaft 108, the desired rotational speed of the laundry mover 24, or the desired agitation of the washing machine 10 or the cycle of operation. Alternatively, embodiments of the disclosure are envisioned wherein the motor 38 does not include a gearbox, and the rotor drive shaft 108 is directly coupled with at least one of the first or second drive shafts 96, 98.

The planetary gearbox 110 can be rotationally supported by one or more sets of bearings 120 fixedly mounted with the motor 38. For example, as illustrated, the planetary gearbox 110 is supported between axially spaced sets of bearings 120 fixedly mounted with, respectively, the upper and lower housing bodies 90, 91. Embodiments of the disclosure are envisioned wherein the second drive shaft 98 can be rotationally coupled with the gearbox housing 111 or ring gear 116, which can be further selectively coupled with the rotor 104 by way of a shifter mechanism 122, which will be further explained below.

The motor 38 operates to generate rotation of the rotor 104 when the stator coil 102 is selectively energized, for example, as controlled by the controller 70. The selective energization of the stator coil 102 generates a magnetic field that interacts with the permanent magnet 106 of the rotor 104 and the interaction generates rotation of the rotor 104 about the stator 100. The rotational speed of the rotor drive shaft 108 reduced by the planetary gearbox 110, as explained herein, and delivered to the laundry mover 24 to rotate the mover 24, which ultimately provides movement to the laundry load contained within the laundry treating chamber 30. The rotor 104 can further be selectively coupled with the basket 22 by way of the shifter mechanism 122, such that the rotation of the rotor 104 further rotates the basket 22.

Figure 4:
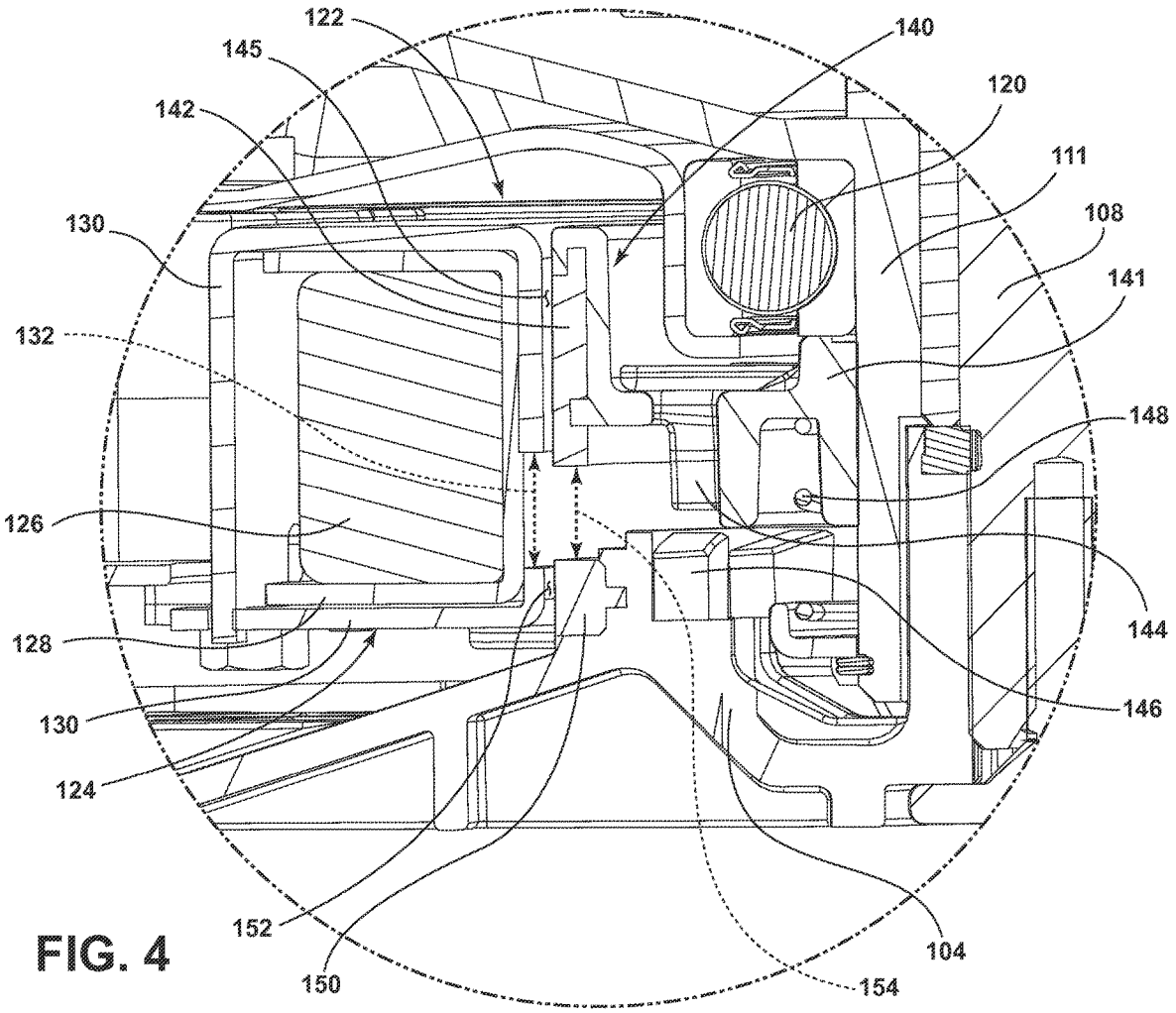
FIG. 4 is a partial cross-sectional view taken along line IV-IV of FIG. 3 showing the shifter in a disengaged position according to one embodiment.

FIG. 4 illustrates a zoomed view of the shifter mechanism 122. The shifter mechanism 122 can include a concentric coil housing 124 positioned within the interior diameter of the stator 100 and a concentric slidable drive mechanism 140 positioned within the interior diameter of the coil housing 124. The coil housing 124 can further include an energizable clutch coil 126, also concentric with the stator 100, and that is supported by the lower housing body 91 of the motor 38 or the stator 100. The coil housing 124, as illustrated, can include a first housing layer 128 configured, for example, to structurally support the clutch coil 126 windings, and a second housing layer 130 configured to at least partially support and envelop the first housing layer 128 and clutch coil 126. The second housing layer 130 can further include at least one gap 132 in the layer 130 at least partially positioned between the clutch coil 126 and the slidable drive mechanism 140. At least the second housing layer 130 can be formed, machined, or manufactured from a magnetically permeable material, such as iron.

As used herein, a magnetically permeable material can include any material having a low magnetic reluctance or capable of defining a magnetic flux path, relative to surrounding components and materials. Additional magnetically permeable materials are envisioned. Further, while first and second housing layers 128, 130 are illustrated, embodiments of the disclosure can include a single housing, or any number of a plurality of housings, wherein at least one housing is a magnetically permeable material.

The slidable drive mechanism 140 can include slidable body 141 rotationally coupled with the second drive shaft 98, for example, by way of the gearbox housing 111, or for example, by way of a splined coupling or mounting, and can be configured such that the slidable body 141 can be axially slid along at least one of the rotor drive shaft 108 or gearbox housing 111. The slidable drive mechanism 140 additionally includes a rotational coupling mechanism, shown as a set of teeth 144 radially configured about the mechanism 140 and positioned proximately to and axially spaced from a set of radially corresponding rotor teeth 146. The teeth 144 of the slidable drive mechanism 140 are keyed to correspond with the rotor teeth 146 such that when the slidable drive mechanism is axially slid downward (that is, downward with reference to FIG. 4), the sets of teeth 144, 146 mesh or engage such that the slidable drive mechanism 140 and rotor 104 co-rotate in unison.

In this sense, the slidable drive mechanism 140 is axially slidable between a first position (illustrated in FIG. 5) that engages co-rotation of the rotor 104 with the gearbox housing 111, and ultimately the basket 22, and a second position (illustrated in FIG. 4) wherein the rotor 104 and slidable drive mechanism 140 are disengaged, and thus the rotor 104 and basket 22 are not in co-rotation. The slidable drive mechanism 140 can further include a biasing element 148, shown as a mechanical spring, configured to bias the slidable body 141 or slidable drive mechanism 140 away from the first position, such that in the absence of any external forces, the slidable drive mechanism 140 rests in the second position.

The slidable drive mechanism 140 can further include a magnetically permeable element 142, such as an iron element, having a major body axis configured to face the coil housing 124 or clutch coil 126. Embodiments of the disclosure are envisioned wherein the magnetically permeable element 142 is a continuous ring or a set of discrete magnetically permeable elements spaced about the concentric slidable drive mechanism 140. The magnetically permeable element 142 is radially spaced from coil housing 124 by at least a first gap 145, such as an air gap, configured to provide rotational clearance between the slidable drive mechanism 140 and the coil housing 124. One non-limiting example clearance provided by the first gap 145 can include 0.75 millimeters, however a greater or a lesser clearance gap is envisioned.

The rotor 104 is further illustrated to include a concentric magnetically permeable ring 150, such as an iron ring, positioned such that it is radially spaced from the coil housing 124 to define a second gap 152 and axially aligned and spaced from the magnetically permeable element 142 of the slidable drive mechanism 140 to define a third gap 154. The second gap 152 is configured to provide rotational clearance between the ring 150 and the coil housing 124, and one non-limiting example clearance provided by the second gap 152 can include 0.75 millimeters, however a greater or a lesser clearance gap is envisioned. The third gap 154 is configured to provide clearance between the magnetically permeable element 142 and the ring 150 when the slidable drive mechanism 140 is in either the first or the second position. Each of the second gap 152 and third gap 154 can include an air gap. Embodiments of the disclosure are envisioned wherein the magnetically permeable ring 150 can include a continuous ring, concentric with the rotor 104, or a set of discrete magnetically permeable elements arranged concentrically with the rotor 104.

The clutch coil 126 is configured to be selectively energizable, for example, in response to a control signal from the controller 70, which in turn generates a magnetic field about the coil 126. The magnetic field generated by the clutch coil 126 is configured to interact with the magnetically permeable element 142 of the slidable drive mechanism 140 to generate an electromagnetic force on the magnetically permeable element 142 in a downward direction (relative to FIG. 4) such that the slidable drive mechanism 140 slides from the resting second position to the first position. In this sense, the energizing of the clutch coil 126 operably results in the engaging or meshing of the teeth 144 of the slidable drive mechanism 140 with the rotor teeth 146 such that the slidable drive mechanism 140, and ultimate the basket 22 and rotor 104 co-rotate in unison. Additionally, the electromagnetic force applied to the magnetically permeable element 142, causing the sliding movement of the slidable drive mechanism 140 can be greater than the bias of the biasing element 148, such that the continuous energization of the clutch coil 146 not only generates the sliding movement as explained herein, but also provides continual retention force to prevent erroneous or accidental disengaging of the co-rotation of the rotor 104 with the basket 22.

Figure 5:
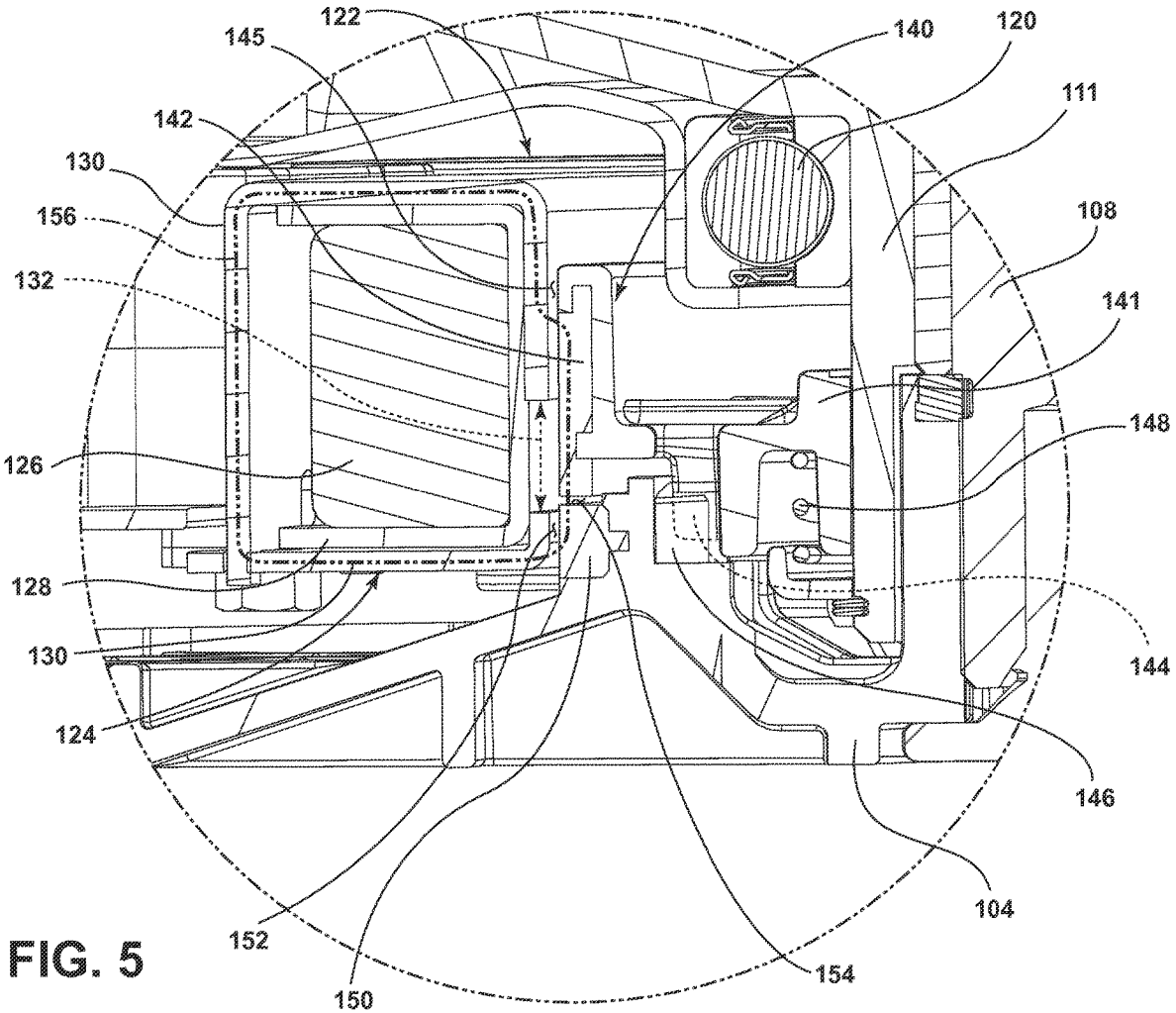
FIG. 5 is a partial cross-sectional view taken along line IV-IV of FIG. 3 showing the shifter in an engaged position according to one embodiment.

FIG. 5 illustrates a zoomed view of the shifter mechanism 122 of FIG. 4, wherein the clutch coil 126 is energized, and the slidable drive mechanism 140 is in the first or engaged position. As shown, the third gap 154 between the magnetically permeable element 142 and the ring 150 is reduced when the slidable drive mechanism 140 is the first position. The third gap 154 can be configured to provide one non-limiting example distance between the ring 150 and magnetically permeable element 142 of 0.5 millimeters, however a greater or a lesser clearance gap is envisioned. Alternatively, embodiments of the disclosure are envisioned wherein the sifter mechanism 122 is configured such that the ring 154 and the magnetically permeable element 142 are in physical contact when the slidable drive mechanism 140 is the first position.

FIG. 5 additionally illustrates the magnetic field generated by the energized clutch coil 126, represented by the dotted line of the magnetic flux path 156. As illustrated, the clutch coil housing 124, the magnetically permeable element 142 of the slidable drive mechanism 140, the ring 150, the first gap 145, the second gap 152, and the third gap 154 collectively define a magnetic flux path 156 of least magnetic reluctance due to, for example, the proximity of the components 124, 142, 150, to each other and about the energized clutch coil 126, and the magnetically permeable composition of the components 124, 142, 150.

Many other possible embodiments and configurations in addition to that shown in the above figures are contemplated by the present disclosure. Additionally, the design and placement of the various components can be rearranged such that a number of different in-line configurations could be realized.

The embodiments disclosed herein provide a laundry treating appliance configured to implement a cycle of operation to treat a load of laundry, wherein a shifter mechanism allows for selective engagement of co-rotation of the basket and laundry mover by a motor, as well as independent rotation of the basket or laundry mover by the motor. One advantage that can be realized in the above embodiments is that the above described motor and planetary gearbox allow for the usage of a smaller BPM motor while providing a similar amount of rotational torque as a larger or more expensive motor, which has to be directly coupled with the basket and laundry mover. Additionally, the planetary gearbox allows for a reduced drive system height. The smaller motor, in addition to the planetary gearbox thus have superior weight and size advantages over the conventional type laundry treating appliance motors. An appliance utilizing the above-described embodiments can utilized the weight and size advantages to, for example, include a larger wash basket, larger treating chamber, or larger wash capacity, or reduce the overall size of the appliance.

Another advantage that can be realized the above embodiments is that the magnetic flux path of the components, as described herein, can be configured to reduce the variation of actuator retention force resulting from manufacturing variation (e.g. the rotational or stationary clearances between the components). A higher or more consistent actuator retention force prevents or reduces the likelihood of erroneous or accidental disengaging of the co-rotation of the rotor with the basket. A reduced variation in the retention force further results in improved manufacturing consistency from unit to unit. Additionally, the improved manufacturing consistency allows for reduced clearances that can further improve the retention forces, without or will less concern that the reduced clearances will result in unsatisfactory results, such as unintended component interaction (e.g. scrapping, damage, and the like or a rotating component contacting a stationary component).

To the extent not already described, the different features and structures of the various embodiments can be used in combination with each other as desired. That one feature cannot be illustrated in all of the embodiments is not meant to be construed that it cannot be, but is done for brevity of description. Thus, the various features of the different embodiments can be mixed and matched as desired to form new embodiments, whether or not the new embodiments are expressly described. Moreover, while "a set of" various elements have been described, it will be understood that "a set" can include any number of the respective elements, including only one element. All combinations or permutations of features described herein are covered by this disclosure.

This written description uses examples to disclose the invention, including the best mode, and also to enable any person skilled in the art to practice the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A laundry treating appliance configured to implement a cycle of operation to treat a load of laundry, comprising:

a basket defining a treating chamber and rotatable about an axis of rotation;

a motor having a rotor and a stator;

a shifter within an interior diameter of the stator and having an energizable clutch coil at least partially enveloped in a magnetically permeable housing and a magnetically permeable slidable drive mechanism radially spaced from the housing and configured to selectively couple the basket with the rotor; and a concentric magnetically permeable ring located on the rotor, radially spaced and axially aligned with a portion of the magnetically permeable housing, and radially aligned and axially spaced from the slidable drive mechanism.

2. The laundry treating appliance of claim 1 wherein the radial spacing between the housing and the slidable drive mechanism defines a first air gap, the radial spacing between the housing and the ring defines a second air gap, and the axial spacing between the slidable drive mechanism and the ring defines a third air gap.

3. The laundry treating appliance of claim 2 wherein the first air gap is less than 0.75 millimeters and the second air gap is less than 0.75 millimeters.

4. The laundry treating appliance of claim 2 wherein the housing, slidable drive mechanism, ring, first air gap, second air gap, and third air gap define a flux path of least magnetic reluctance for a magnetic field selectively generated by the energizable clutch coil.

5. The laundry treating appliance of claim 4 wherein the slidable drive mechanism is configured to slide between a first position that engages co-rotation of the rotor with the basket and a second position that disengages co-rotation of the rotor with the basket.

6. The laundry treating appliance of claim 5, wherein the third air gap is less than 0.5 millimeters when the slidable drive mechanism is in the first position.

7. The laundry treating appliance of claim 5 wherein the interaction of the magnetic field selectively generated by the energizable clutch coil with the slidable drive mechanism is configured to place the slidable drive mechanism in the first position.

8. The laundry treating appliance of claim 7 wherein the slidable drive mechanism is configured to slide axially along at least a portion of the motor.

9. The laundry treating appliance of claim 8 wherein the shifter further includes a biasing element to bias the slidable drive mechanism toward the second position.

10. The laundry treating appliance of claim 9 wherein the flux path is configured such that the interaction of the magnetic field selectively generated by the energizable clutch coil with the slidable drive mechanism is greater than the bias of the biasing element.

11. The laundry treating appliance of claim 1 wherein the magnetically permeable ring is a continuous ring.

12. The laundry treating appliance of claim 1 wherein the magnetically permeable ring is a set of discrete magnetically permeable elements.

13. A laundry treating appliance configured to implement a cycle of operation to treat a load of laundry, comprising:

a basket defining a treating chamber and rotatable about an axis of rotation;

a motor having a rotor and a stator;

a shifter within an interior diameter of the stator and having an energizable clutch coil at least partially enveloped in a magnetically permeable housing and a magnetically permeable slidable drive mechanism radially spaced from the housing to define a first gap and configured to selectively couple the basket with the rotor; and a concentric magnetically permeable ring located on the rotor, radially spaced and axially aligned with a portion of the housing to define a second gap, and radially aligned and axially spaced from the slidable drive mechanism to define a third gap;

wherein the housing, slidable drive mechanism, ring, first gap, second gap, and third gap define a flux path of least magnetic reluctance for a magnetic field selectively generated by the energizable clutch coil.

14. The laundry treating appliance of claim 13 wherein the slidable drive mechanism is configured to slide between a first position that engages co-rotation of the rotor with the basket and a second position wherein the basket that disengages co-rotation of the rotor with the basket.

15. The laundry treating appliance of claim 14, wherein the third gap is less than 0.5 millimeters when the slidable drive mechanism is in the first position.

16. The laundry treating appliance of claim 14 wherein the interaction of the magnetic field selectively generated by the energizable clutch coil with the slidable drive mechanism is configured to place the slidable drive mechanism in the first position.

17. The laundry treating appliance of claim 16 wherein the shifter further includes a biasing element to bias the slidable drive mechanism toward the second position and the flux path is configured such that the interaction of the magnetic field selectively generated by the energizable clutch coil with the slidable drive mechanism is greater than the bias of the biasing element.

18. The laundry treating appliance of claim 14 wherein the magnetically permeable ring is a continuous ring.

19. The laundry treating appliance of claim 14 wherein the magnetically permeable ring is a set of discrete magnetically permeable elements.

20. A laundry treating appliance configured to implement a cycle of operation to treat a load of laundry, comprising:

a basket defining a treating chamber and rotatable about an axis of rotation;

a motor having a rotor and a stator;

a shifter within an interior diameter of the stator and having:

an energizable clutch coil at least partially enveloped in a magnetically permeable housing, the magnetically permeable housing having a gap; and a magnetically permeable slidable drive mechanism radially spaced from the housing and configured to selectively couple the basket with the rotor in a first position and to selectively uncouple the basket with the rotor in a second position; and a concentric magnetically permeable ring located on the rotor, radially spaced and axially aligned with a portion of the magnetically permeable housing and radially aligned and axially spaced from the slidable drive mechanism;

wherein the magnetically permeable housing gap is at least partially positioned between the clutch coil and the slidable drive mechanism, and wherein the slidable drive mechanism substantially overlies the gap when in the first position and does not substantially overlie the gap when in the second position.

* * * * *